US008226204B2

(12) United States Patent
Sato

(10) Patent No.: US 8,226,204 B2
(45) Date of Patent: Jul. 24, 2012

(54) FLUID EJECTING APPARATUS

(75) Inventor: Seiya Sato, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 513 days.

(21) Appl. No.: 12/167,486

(22) Filed: Jul. 3, 2008

(65) Prior Publication Data

US 2009/0009555 A1 Jan. 8, 2009

(30) Foreign Application Priority Data

Jul. 6, 2007 (JP) ..... 2007-178378
Apr. 30, 2008 (JP) ..... 2008-118537

(51) Int. Cl.
*B41J 2/165* (2006.01)

(52) U.S. Cl. ..... 347/29

(58) Field of Classification Search ..... None
See application file for complete search history.

(56) References Cited

U.S. PATENT DOCUMENTS 4,947,191 A * 8/1990 Nozawa et al. ..... 347/30
6,508,533 B2 * 1/2003 Tsujimoto et al. ..... 347/30
2003/0085963 A1 * 5/2003 Asakawa et al. ..... 347/70

FOREIGN PATENT DOCUMENTS

JP 06-328702 11/1994

* cited by examiner

*Primary Examiner* — Matthew Luu
*Assistant Examiner* — Alejandro Valencia
(74) *Attorney, Agent, or Firm* — Maschoff Gilmore & Israelsen

(57) ABSTRACT

A fluid ejecting apparatus for ejecting a fluid includes a recording head and a capping device. The recording head includes a storage portion and a plurality of ejection nozzles. The capping device comes into contact with a discharge surface of the fluid in the recording head and receives the fluid discharged through the nozzles. The recording head capping device includes a cap-side channel and a passing portion. The cap-side channel faces the nozzles when the recording head capping device is in contact with the discharge surface. The passing portion creates negative pressure in the nozzles by passing a material in the cap-side channel. The cap-side channel includes a high flow rate section and a low flow rate section.

5 Claims, 7 Drawing Sheets

(SLIDE IN +X DIRECTION)

FLUID EJECTING APPARATUS

BACKGROUND OF THE INVENTION

The entire disclosure of Japanese Patent Application No. 2007-178378, filed Jul. 6, 2007 and Japanese Patent Application No. 2008-118537 filed Apr. 30, 2008 are expressly incorporated herein by reference.

1. Technical Field

The present invention relates to a fluid ejecting apparatus. More specifically, the present invention relates to a technique for eliminating clogged nozzles in an fluid ejecting apparatus.

2. Related Art

An ink jet recording apparatus performs a printing process by discharging ink onto a recording sheet through a plurality of nozzles. In some instances, however, when ink becomes thickened in the nozzles or air bubbles are introduced into the nozzles, the nozzles may become clogged, causing them to be able to satisfactorily discharge ink during the printing process. One approach to addressing this problem described in Japanese Patent No. JP-A-6-328702 is an ink jet recording apparatus that is capable of removing air bubbles or thickened ink in the nozzles using a suction process, wherein a negative pressure is created within a dedicated cap that covers the discharge surface of the recording head.

In some instances, the ink jet recording apparatus performs a suction operation on all nozzles simultaneously. In order to achieve this, it is necessary to create a large amount of negative pressure or suction power. For example, when a line recording head is used, several thousand nozzles may be cleaned in a single operation, meaning that a large amount of negative pressure is needed. Thus, the pump for creating the negative pressure is inevitably large, which increases the size and cost of the ink jet recording apparatus.

Similar problems exist when the fluid ejecting apparatus has a serial-recording head. Thus, there is a need for a fluid ejecting apparatus that is capable of efficiently cleaning the nozzles more efficiently.

BRIEF SUMMARY OF THE INVENTION

An advantage of some aspects of the invention is that it provides a technique for eliminating clogs in the nozzles of a fluid ejecting apparatus without having to use a large-scale mechanism to create the negative pressure.

The invention is made to solve at least part of the previously described problems and can be realized by applying the teachings and examples described below.

One aspect of the invention is a fluid ejecting apparatus for ejecting a fluid which includes a recording head and a recording head capping device. The recording head includes a storage portion for storing the fluid and a plurality of nozzles which are capable of ejecting the fluid. The recording head capping device is capable of coming into contact with a discharge surface of the recording head where the nozzles are formed and receiving the fluid discharged through the plurality of nozzles. The recording head capping device includes a cap-side channel and a passing portion. The cap-side channel is arranged so as to face the plurality of nozzles when the recording head capping device is in contact with the discharge surface. The passing portion creates negative pressure in at least part of the plurality of nozzles by passing material in the cap-side channel. The cap-side channel includes a high flow rate section wherein the flow rate of the material is relatively high and a low flow rate section wherein the flow rate of the material is relatively low where the cap-side channel faces the plurality of nozzles.

A second aspect of the invention is a fluid ejecting apparatus capable of ejecting a fluid which includes a recording head and a recording head capping device. The recording head includes a storage portion for storing the fluid and a plurality of nozzles. The recording head ejects the fluid through the plurality of nozzles. The recording head capping device comes into contact with a discharge surface of recording head and receives the fluid discharged through the plurality of nozzles. The recording head capping device includes a cap-side channel, a passing portion, a narrowing portion, and a positioning portion. The cap-side channel faces the plurality of nozzles when the recording head capping device is in contact with the discharge surface. The passing portion creates negative pressure in at least part of the plurality of nozzles by passing a material through the cap-side channel. The narrowing portion is arranged in the cap-side channel and is capable of narrowing a portion of the cap-side channel. The positioning portion adjusts the position of the narrowed portion of the cap-side channel. The cap-side channel includes a high flow rate section wherein the flow rate of the material is relatively high and a low flow rate section wherein the flow rate of the material is relatively low. The positioning portion creates the high flow rate section by narrowing a portion of the cap-side channel.

A third embodiment of the invention is fluid ejecting apparatus for ejecting a fluid which includes a recording head and a recording head capping device. The recording head includes a storage portion for storing the fluid and a plurality of nozzles. The recording head ejects the fluid through the plurality of nozzles. The recording head capping device comes into contact with a discharge surface of the recording head and receives the fluid discharged through the plurality of nozzles. The recording head capping device includes a cap-side channel, a passing portion, a narrowing portion, and a positioning portion. The cap-side channel faces the plurality of nozzles when the recording head capping device is in contact with the discharge surface. The passing portion creates negative pressure in at least part of the plurality of nozzles by passing a material through the cap-side channel. The narrowing portion is arranged in the cap-side channel and is capable of narrowing the cap-side channel. The positioning portion adjusts a placement position of the narrowing portion in the cap-side channel. The positioning portion places the narrowing portion over a predetermined section in the cap-side channel in order to create a portion with a reduced cross-sectional area.

Accordingly, a mechanism for creating negative pressure in a fluid ejecting apparatus in order to remove air bubbles and thickened ink in the nozzles can be created without increasing the size of the apparatus.

BRIEF DESCRIPTION OF THE DRAWINGS

The invention will be described with reference to the accompanying drawings, wherein like numbers reference like elements.

DESCRIPTION OF EXEMPLARY EMBODIMENTS

Best modes for carrying out aspects of the invention will be described below on the using various embodiments, which will be described in the following order:

A. First Embodiment

B. Second Embodiment

C. Third Embodiment

D. Modification Examples

A. First Embodiment

Figure 1:
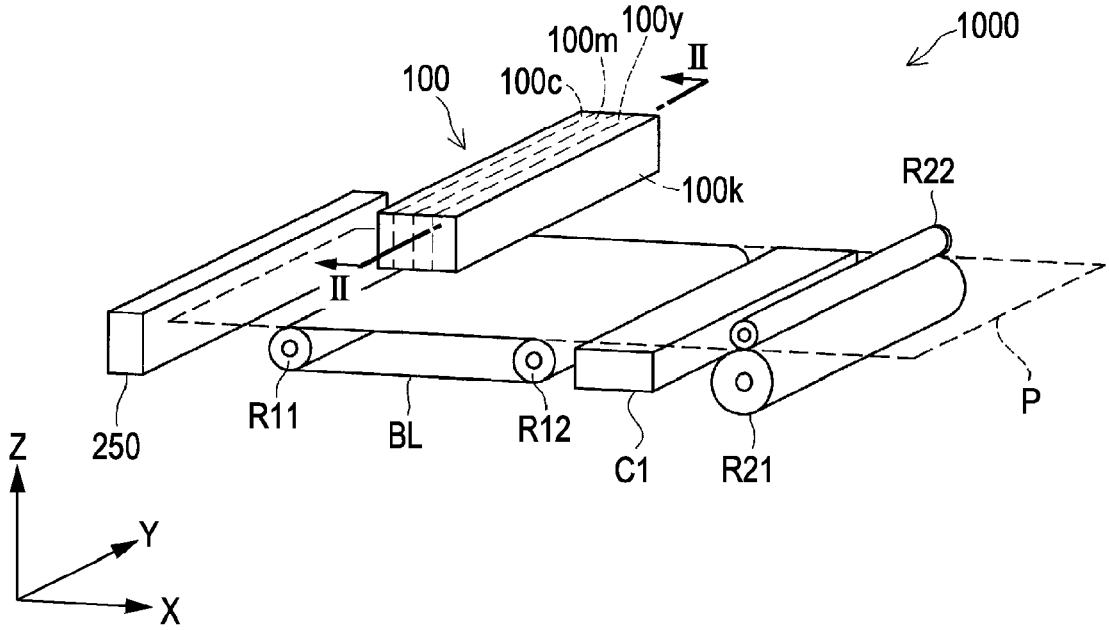
FIG. 1 illustrates an exemplary schematic structure of an ink jet printer, which comprises an example of a fluid ejecting apparatus capable of performing aspects of the invention.

FIG. 1 illustrates an exemplary structure of an ink jet printer, which is an example of a fluid ejecting apparatus capable of performing aspects of the invention according to one embodiment of the invention. The printer 1000 includes a recording head 100, a cap C1, a paper feed device 250, a paper transport belt BL, two belt driving rollers R11 and R12 for driving the paper transport belt BL, and two paper output rollers R21 and R22. The cap C1 is arranged between the paper transport belt BL and the paper output roller R21.

During a printing process, the paper feed device 250 feeds a printing sheet P in a +X direction. The paper transport belt BL further transports the printing sheet fed by the paper feed device 250 in the +X direction. The printing sheet P continues to be transported by the paper transport belt BL until the printing sheet P is ejected from between the paper output rollers R21 and R22. During the printing process, the recording head 100 is fixed above the upper surface of the paper transport belt BL and discharges ink onto the printing sheet P as it is transported over the paper transport belt BL. The paper transport belt BL and the two belt driving rollers R11 and R12 correspond to a scanning portion. The +X direction corresponds with a predetermined scanning direction.

During a maintenance operation for eliminating clogs in the nozzle (hereinafter referred as maintenance mode), the recording head 100 comes into contact with the cap C1 by being moved by a recording head moving mechanism (not shown). The cap C1 performs a sucking operation in the maintenance mode to eliminate any clogs in the nozzle. The maintenance mode can be started, for example, at the time when printing is not being performed upon a request from a user or at the time when the power of the printer 1000 is switched on.

The recording head 100 is a so-called line recording head. The width of the recording head 100, which extends in the Y-axis direction, is slightly longer than the width of the printing sheet P, so the recording head 100 can discharge ink across the entire width of the printing sheet P simultaneously. The number of colors of ink that the recording head 100 can discharge may vary, but in this embodiment is four. The colors are cyan (C), magenta (M) yellow (Y), and black (K). Thus, the recording head 100 includes four recording head portions which correspond to the four colors of ink (CMYK). The four recording head portions are arranged in the X-axis direction. More specifically, the recording head 100 includes a recording head portion 100*c* for discharging cyan ink, a recording head portion 100*m* for discharging magenta ink, a recording head portion 100*y* for discharging yellow ink, and a recording head portion 100*k* for discharging black ink. The number of colors of ink to be discharged is not limited to four and can be any number, such as one or six.

Figure 2:
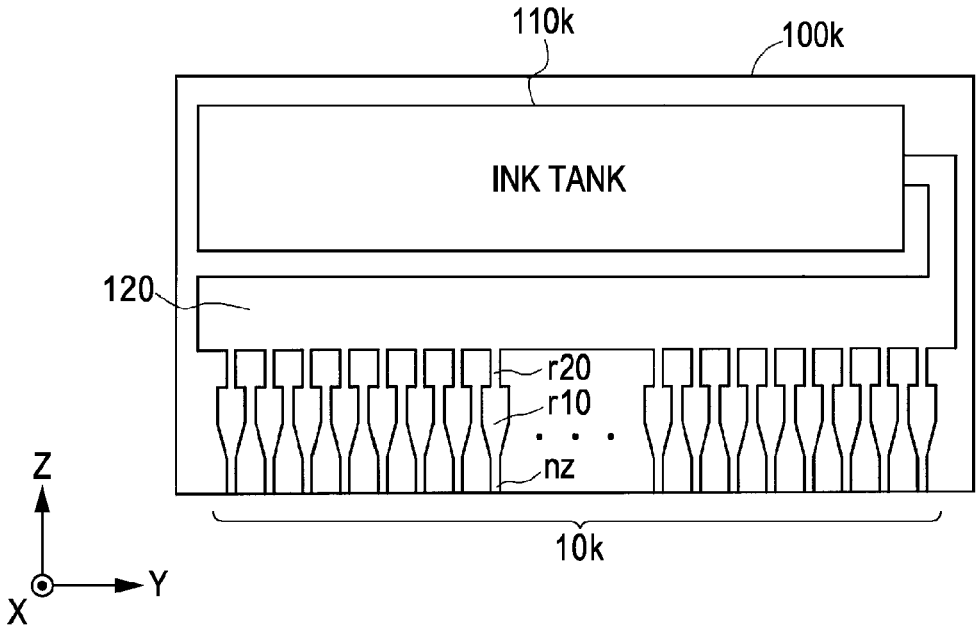
FIG. 2 is a cross-sectional view of a recording head portion taken along the line II-II illustrated in FIG. 1.

FIG. 2 is a cross-sectional view of the recording head portion 100*k* taken along the line II-II illustrated in FIG. 1. The recording head portion 100*k* includes an ink tank 110*k* for storing black ink, a plurality of nozzles nz arranged in the Y-axis direction, and an ink supply passageway 120.

One end of each of the nozzles nz communicates with a pressure chamber r10, whereas the other end extends to the outside of the recording head portion 100*k*. Thus, a group 10*k* of nozzles (hereinafter referred to as a nozzle hole bank 10*k*) arranged in the Y-axis direction is defined on the bottom surface of the recording head portion 100*k*. The pressure chamber r10 communicates with the ink supply passageway 120 via an ink flow path r20. The pressure chamber r10 is in contact with a piezoelectric vibrator (not shown), such as a piezoelectric element. Ink droplets are discharged through each of the nozzles nz by a change in the shape of the pressure chamber r10 which is caused by expansion and contraction of the piezoelectric vibrator. In the description described below, the nozzle nz, the pressure chamber r10, and the ink flow path r20 are also collectively referred to simply as the "nozzle nz". The other three recording head portions 100*c*, 100*m*, and 100*y* have substantially the same structure as that of the recording head portion 100*k*.

Figure 3:
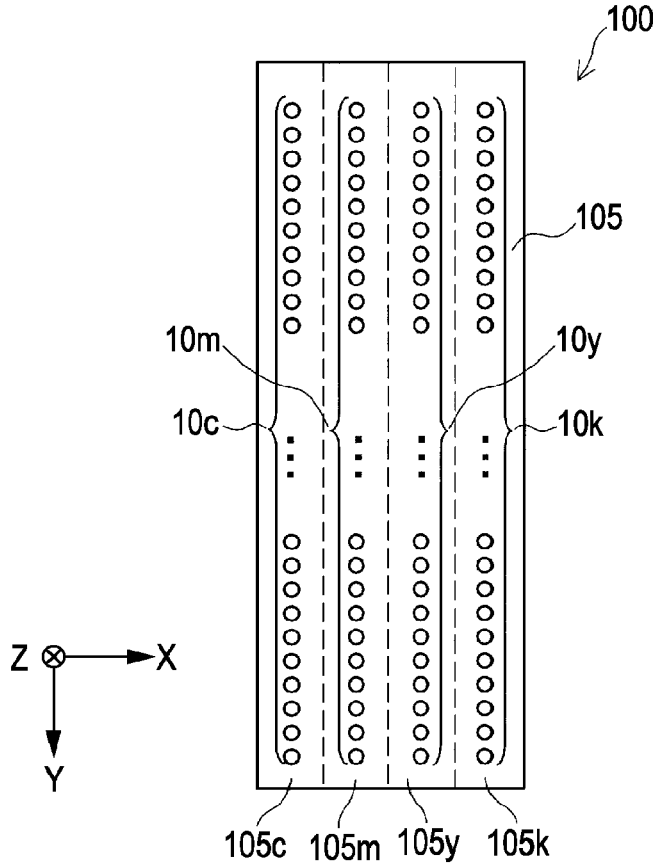
FIG. 3 illustrates a bottom surface of a recording head illustrated in FIG. 1.

FIG. 3 illustrates a bottom surface of the recording head 100 illustrated in FIG. 1. A nozzle plate 105 is disposed on the bottom of the recording head 100. The nozzle plate 105 includes four bottom portions 105*c*, 105*m*, 105*y*, and 105*k*. The bottom portion 105*c* corresponds to the recording head portion 100*c*, shown in FIG. 1. Similarly, the bottom portions 105*m*, 105*y*, and 105*k* correspond to the recording head portions 100*m*, 100*y*, and 100*k*, respectively. Each of the bottom portions 105*c*, 105*m*, 105*y*, and 105*k* has a nozzle hole bank consisting of a plurality of nozzles arranged in the Y-axis direction. More specifically, the bottom portion 105*c* includes a nozzle hole bank 10*c*. Similarly, the bottom portions 105*m*, 105*y*, and 105*k* include nozzle hole banks 10*m*, 10*y*, and 10*k*, respectively. The number of nozzles nz in each of the nozzle hole banks 10*c*, 10*m*, 10*y*, and 10*k* can be 6400, for example.

Figure 4:
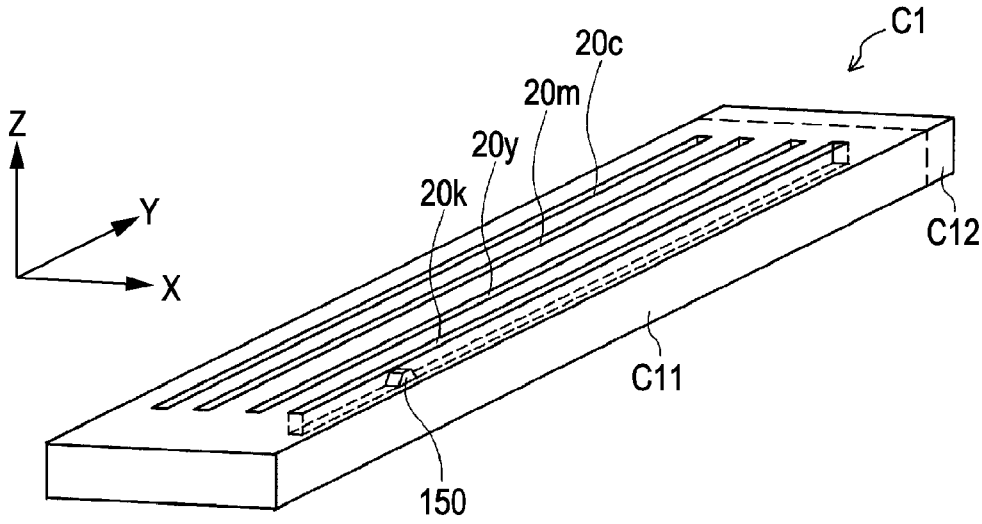
FIG. 4 illustrates the detailed structure of a cap illustrated in FIG. 1.

FIG. 4 illustrates an exemplary detailed structure of the cap C1 illustrated in FIG. 1. The cap C1 includes a cap portion C11 and a suction portion C12. The size of the upper surface of the cap portion C11 is substantially the same as the size of the nozzle plate 105 shown in FIG. 3. Four grooves which extend along the longitudinal or Y-axis direction are arranged as rows along the X-axis direction in the upper surface of the cap portion C11. More specifically, an ink flow channel 20*k* is disposed at a location that corresponds to the nozzle hole bank 10*k* formed in the bottom surface of the recording head 100. Similarly, an ink flow channel 20*c* is disposed at a location that corresponds to the nozzle hole bank 10*c*, an ink flow channel 20*m* is disposed at a location that corresponds to the nozzle hole bank 10*m*, and an ink flow channel 20*y* is disposed at a location that corresponds to the nozzle hole bank 10*y*. The ink flow channels 20*c*, 20*m*, 20*y*, and 20*k* have substantially the same size. The shape of the cross section of each of the ink flow channels 20*c*, 20*m*, 20*y*, and 20*k* can be a square, which extends to form a channel that is 3 mm in length. As may be understood by one of skill in the art, however, the cross section can have any shape, such as a rectangular and circular shape. A resin sealing portion (not shown) formed of, for example, silicone rubber is disposed around the ink flow channels 20*c*, 20*m*, 20*y*, and 20*k* so as to ensure a high airtightness when the recording head 100 and the cap C1 (cap portion C11) are in contact with each other.

A narrowing unit 150 is arranged within the ink flow channel 20*k*. The narrowing unit 150 is made from magnetic substance (e.g., ferromagnetic stainless steel) and is arranged so as to be capable of freely reciprocating in the Y-axis direction. A narrowing unit (not shown) similar to the narrowing unit 150 is also arranged in each of the ink flow channels 20*c*, 20*m*, and 20*y*, so as to be capable of freely reciprocating in each of those channels.

Figure 5:
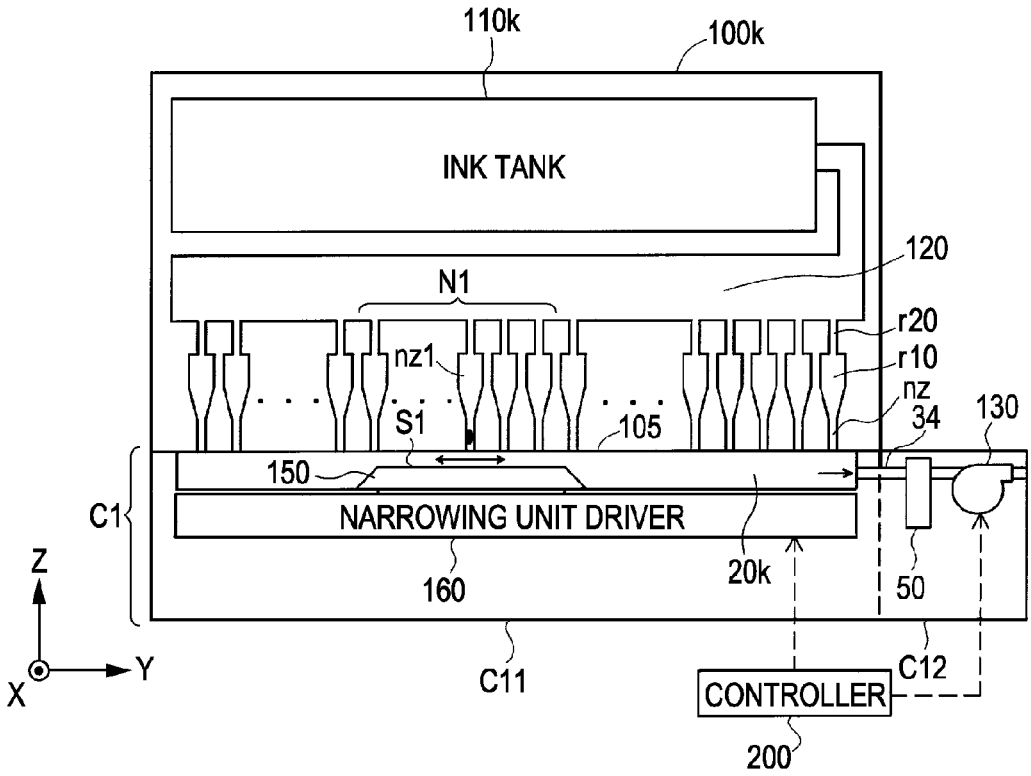
FIG. 5 illustrates the recording head portion and the cap in maintenance mode according to a first embodiment of the invention.

FIG. 5 illustrates the recording head portion 100*k* and the cap C1 in maintenance mode according to a first embodiment. In FIG. 5, a cross section of the recording head portion 100*k* and cap C1 is taken along the line II-II of FIG. 1, is illustrated. The cap C1 includes a narrowing-unit driver 160 for driving the narrowing unit 150 such that the narrowing unit 150 can freely reciprocate in the Y-axis direction. The suction portion C12 includes a suction channel 34 which is in communication with the ink flow channel 20*k*, a filter 50 positioned within the suction channel 34, and a pump 130 connected to the suction channel 34 via the filter 50.

One example of the narrowing-unit driver 160 is a mechanism for driving the narrowing unit 150 by bringing an electromagnet (not shown) into contact with the bottom of the ink flow channel 20*k* and sliding the electromagnet so as to move in the Y-axis direction. Alternatively, a structure can be used wherein the bottom surface of the ink flow channel 20*k* is formed as a belt that can freely slide in the Y-axis direction. In this case, the narrowing unit 150 mounted on the belt slide in the Y-axis direction by the narrowing-unit driver 160 driving the belt.

The printer 1000 also includes a controller 200 having a memory and a central processing unit (CPU), which are not shown in the drawings. The controller 200 can adjust the placement position of the narrowing unit 150 by controlling the narrowing-unit driver 160 in accordance with a program stored in the memory. The pump 130 sucks in air within the ink flow channel 20*k* via the suction channel 34 and the filter 50. The controller 200 also controls an operation of the pump 130.

The narrowing-unit driver 160 comprises a positioning portion. The pump 130 comprise a passing portion. The ink flow channels 20*c*, 20*m*, 20*y*, and 20*k* comprise a cap-side channel.

During the maintenance mode, the recording head 100 moves to a location corresponding to the position of the cap C1 and stops directly above the cap C1. Then, a nozzle which has been unable to satisfactorily discharge ink because of a clog (hereinafter referred to as a poorly discharging nozzle) is located. One exemplary process for locating a poorly discharging nozzle is described below.

In one process for locating poorly discharging nozzles, the piezoelectric vibrator is sequentially driven in order discharge ink from the nozzles nz. The presence or absence of discharged ink is optically detected to determine a poorly discharging nozzle. One example of a mechanism for optically detecting the presence or absence of discharged ink is a combination of a laser emitting device and a photodiode serving as a sensor. Such an example mechanism can detect whether ink has been discharged from a nozzle by detecting a reduction in the amount of laser light caused by the discharged ink blocking the laser light.

After a poorly discharging nozzle is located, the recording head 100 comes into contact with the cap C1. When the recording head 100 comes into contact with the cap C1, the controller 200 performs a sucking operation. More specifically, first, the narrowing-unit driver 160 is driven such that the center of the narrowing unit 150 is aligned with the location of the poorly discharging nozzle. In the example illustrated in FIG. 5, the narrowing unit 150 is placed such that its center is aligned with the poorly discharging nozzle nz1. The length of the top surface S1 of the narrowing unit 150 can be one-twentieth of the length of the ink flow channel 20*k*. In this case, 320, or 6,400 divided by 20, nozzles nz are positioned directly above the top surface S1. The length of the top surface S1 is not limited to one-twentieth of the length of the ink flow channel 20*k* and can be any length, such as one-third. After the narrowing unit 150 is placed such that its center is aligned with the location of the poorly discharging nozzle nz1, the controller 200 controls the pump 130 to suck in air within the ink flow channel 20*k*.

Figure 6:
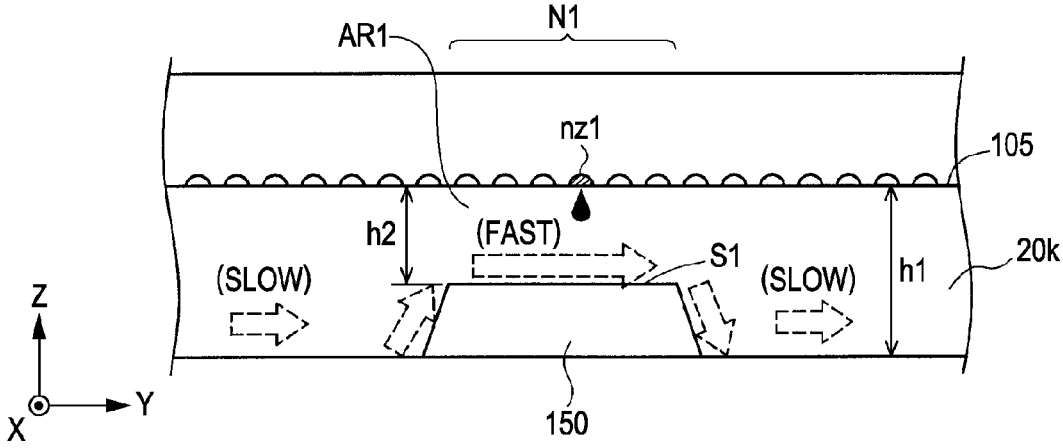
FIG. 6 is a schematic diagram of a narrowing unit and its surroundings wherein suction is performed according to the first embodiment.

FIG. 6 is a schematic diagram of the narrowing unit 150 and its surroundings when a sucking operation is being performed. When the pump 130 (FIG. 5) starts the sucking process, a current of air occurs in the ink flow channel 20*k* in the +Y direction, which moves toward the pump 130. As a result, negative pressure is created in each nozzle nz which is directed toward the ink flow channel 20*k* from the ink supply passageway 120. Here, the space through which air passes in the channel where the narrowing unit 150 is absent is h1, which in one embodiment, may be 3 mm. The height of a space AR1 through which air passes at the location where the narrowing unit 150 is placed, corresponding to nozzle group N1, is h2. The height h2 is smaller than the height h1 by the width of the narrowing unit 150, which in one embodiment is 0.5 mm. Because the space AR1 within the ink flow channel 20*k* is narrowed, the speed of the current of air in the space AR1 is higher than the speed of the current of air in the other areas. Therefore, negative pressure or suction power in the nozzle group N1 is higher than that in the other areas. Accordingly, any bubbles and/or thickened ink remaining in the poorly discharging nozzle nz1 of the nozzles nz constituting the nozzle group N1 can be discharged. The section where the space AR1 is present in the ink flow channel 20*k* comprises a smaller-cross section area where the flow rate is higher. The other sections comprise low flow rate section with larger cross-sectional areas.

In the nozzles other than the nozzle group N1, the speed of the current of air is relatively slow. Thus, even if thickened ink remains in the nozzles, there is not enough negative pressure to cause the discharge, so the thickened ink is not discharged. The optimal suction power of the pump 130 and height of the narrowing unit 150 for producing negative pressure capable of discharging ink form only the nozzle group N1 can be determined by experiment. Air bubbles and thickened ink discharged from the poorly discharging nozzle nz1 pass through the suction channel 34 shown in FIG. 5, and are absorbed in the filter 50. The home position of the narrowing unit 150 can be the leftmost location of the ink flow channel 20*k* shown in FIG. 5. This location is suitable because it corresponds to the location that is furthest from the ink tank 110*k* in the ink supply passageway 120 where the flow rate of the ink is relatively low at this location, and ink is most likely be thickened in the nozzles nz.

An exemplary operation of the recording head portion 100*k* in maintenance mode is described above. The same applies to the other three recording head portions 100*c*, 100*m*, and 100*y*. When a plurality of nozzles nz has been detected as a poorly discharging nozzle, the above sucking operation can be performed on each of the detected poorly discharging nozzles nz. At this time, relatively high negative pressure is produced in 320 nozzles nz during a single sucking operation, so a plurality of nozzles can be recovered from a poor discharge condition at one time. Then sucking operations can also be performed on the other poorly discharging nozzles.

As described above, a large amount of negative pressure is generated and targeted for the nozzle group N1 (320 nozzles) which surrounds the poorly discharging nozzle. Therefore, it is unnecessary for the pump 130 to have suction power sufficient to apply high negative pressure to all the nozzles nz. Accordingly, the clogging of a nozzle can be eliminated without having to use a large-scale mechanism to creating negative pressure.

B. Second Embodiment

Figure 7:
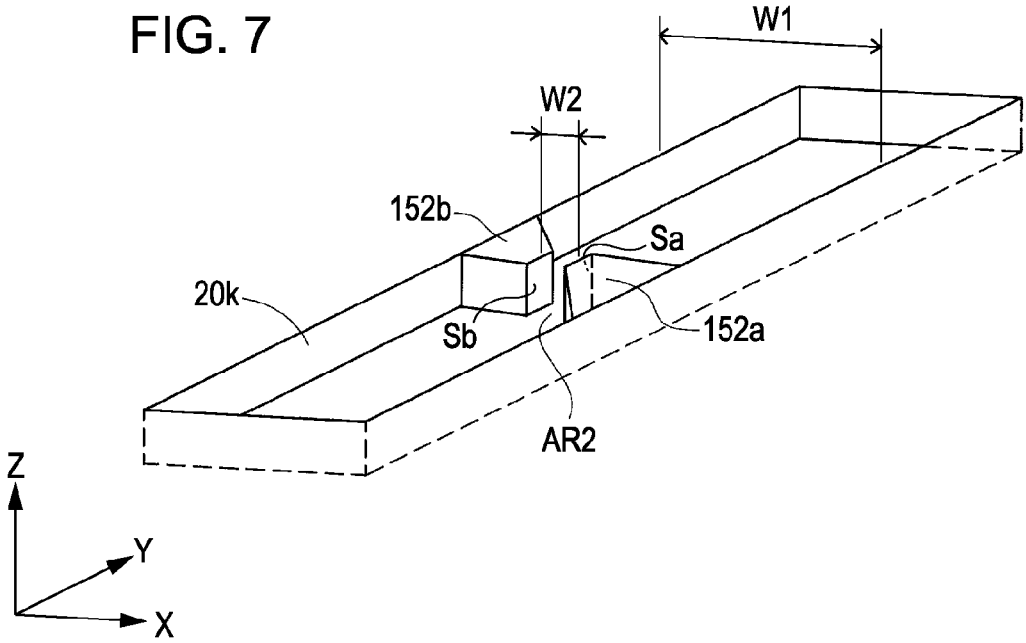
FIG. 7 illustrates an exemplary structure of the ink flow channel according to a second embodiment of the invention.

FIG. 7 illustrates an exemplary structure of the inside of the ink flow channel 20*k* according to a second embodiment of the invention. The printer according to the second embodiment (not shown) differs from the printer 1000 shown in FIGS. 1 to 5 in the specific configuration of a narrowing unit in each of the ink flow channels 20*c*, 20*m*, 20*y*, and 20*k*, and is otherwise substantially the same as that in the other structures.

More specifically, in the configuration of the second embodiment, two narrowing units are disposed in each of the ink flow channels 20*c*, 20*m*, 20*y*, and 20*k*. In the example illustrated in FIG. 7, two narrowing units 152*a* and 152*b* are disposed in the ink flow channel 20*k*. The two narrowing units 152*a* and 152*b* have substantially the same size, are shaped like a trapezoidal prism, and are arranged in the X-axis direction so as to face each other. The surface Sa of the narrowing unit 152*a* that faces the narrowing unit 152*b* and the surface Sb of the narrowing unit 152*b* that faces the narrowing unit 152*a* are substantially parallel to each other with a gap AR2 having a predetermined length (W2) disposed therebetween. The height of the two narrowing units 152*a* and 152*b* (the length in the Z-axis direction) is substantially the same as the depth of the ink flow channel 20*k*. The two narrowing units 152*a* and 152*b* are capable of freely reciprocating in the Y-axis direction.

Figure 8:
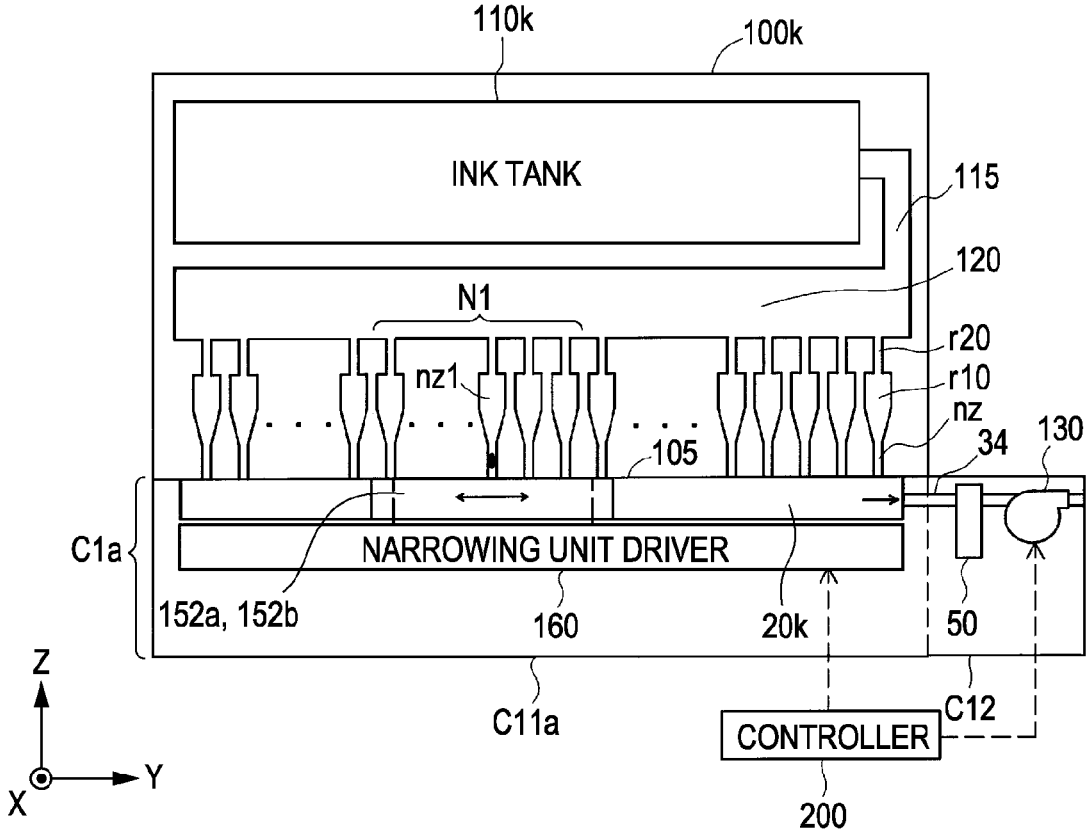
FIG. 8 illustrates a recording head portion and a cap in maintenance mode according to the second embodiment of the invention.

FIG. 8 illustrates the recording head portion 100*k* and a cap C1*a* in maintenance mode according to the second embodiment. In FIG. 8, a cross section of the recording head portion 100*k* and cap C1*a* taken along the line II-II is illustrated. When the cap C1*a* covers the nozzle plate 105 of the recording head portion 100*k* after locating a poorly discharging nozzle, the two narrowing units 152*a* and 152*b* in a cap portion C11*a* are both slid so that their centers match with the poorly discharging nozzle nz1. When the two narrowing units 152*a* and 152*b* are placed at a predetermined position, the pump 130 starts sucking, as in the first embodiment.

Figure 9:
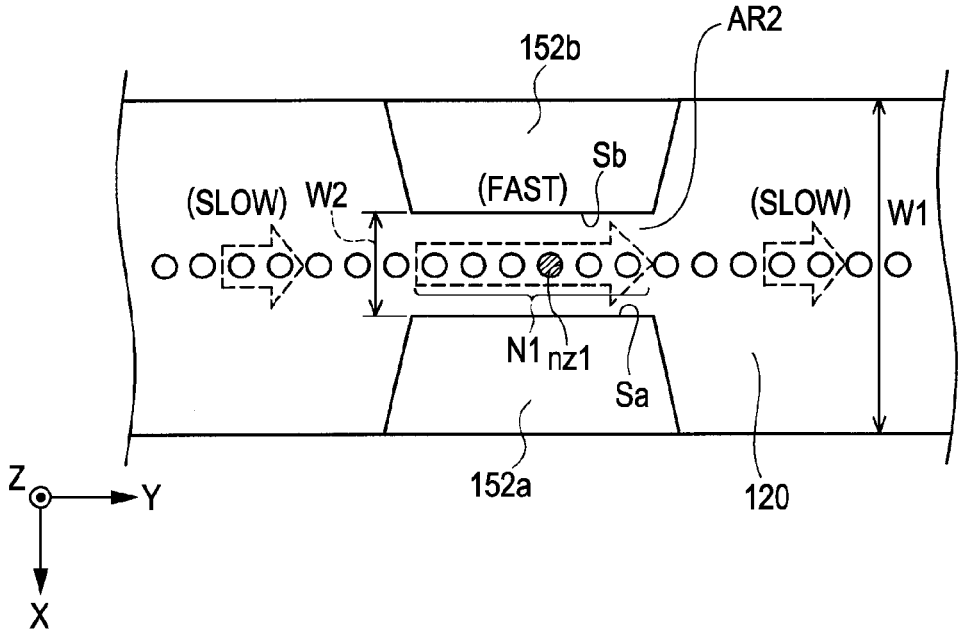
FIG. 9 is a schematic diagram of two narrowing units when suction is performed according to the second embodiment of the invention.

FIG. 9 is a schematic diagram of the two narrowing units 152*a* and 152*b* and their surroundings when sucking is performed according to the second embodiment. Unlike FIG. 6, FIG. 9 illustrates the recording head 100 and the cap portion C11*a* viewed from above, in the −Z direction. The width W2 of the space AR2 is smaller than the width W1 of a space through which air passes in the other areas. As a result, the path of the current of air in the gap AR2 is relatively narrow, and thus, the rate of flow in this area is relatively high. Therefore, negative pressure is relatively high in the nozzles of the nozzle group N1, and air bubbles and thickened ink remaining in the poorly discharging nozzle nz1 can be removed, as in the case of the first embodiment.

C. Third Embodiment

Figure 10:
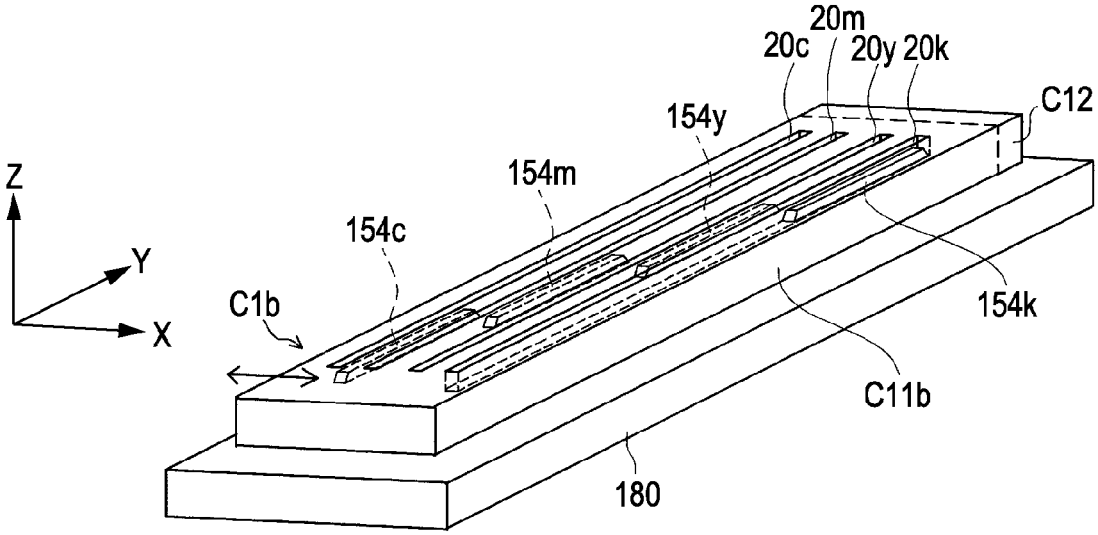
FIG. 10 illustrates an exemplary structure of a cap and a cap sliding device according to a third embodiment of the invention.

FIG. 10 illustrates an exemplary structure of a cap and a cap sliding device according to a third embodiment of the invention. The printer according to the third embodiment (not shown) differs from the printer 1000 shown in FIGS. 1 to 5 in that a narrowing unit is not slid and instead the cap is slid. The printer according to the present embodiment is substantially the same as the printer 1000 in the other structures.

A cap C1*b* according to the third embodiment includes four ink flow channels 20*c*, 20*m*, 20*y*, and 20*k* disposed in a cap portion C11*b*, as in the case of the first embodiment. However, the size of the narrowing unit arranged in each of the ink flow channels 20*c*, 20*m*, 20*y*, and 20*k* is larger than that of the narrowing unit 150 in the first embodiment. More specifically, the length of a narrowing unit 154*k* disposed in the ink flow channel 20*k* (the length in the Y-axis direction) corresponds to a quarter of the length of the ink flow channel 20*k*. The length in the X-axis direction (width) and the length in the Z-axis direction (height) are substantially the same as those of the narrowing unit 150 of to the first embodiment, shown in FIGS. 4 and 5. Narrowing units 154*c*, 154*m*, and 154*y* having substantially the same size as that of the narrowing unit 154*k* are disposed in the ink flow channels 20*c*, 20*m*, and 20*y*, respectively.

The four narrowing units 154*c*, 154*m*, 154*y*, and 154*k* are arranged so as not to overlap each other as viewed from the X-axis direction. The four narrowing units 154*c*, 154*m*, 154*y*, and 154*k* are fixed and cannot be slid so as to be capable of freely reciprocating, unlike the first embodiment.

A cap sliding device 180 is disposed below the cap C1*b*. The cap sliding device 180 includes a motor (not shown) which can slide the cap C1*b* as a whole in the X-axis direction.

Figure 11:
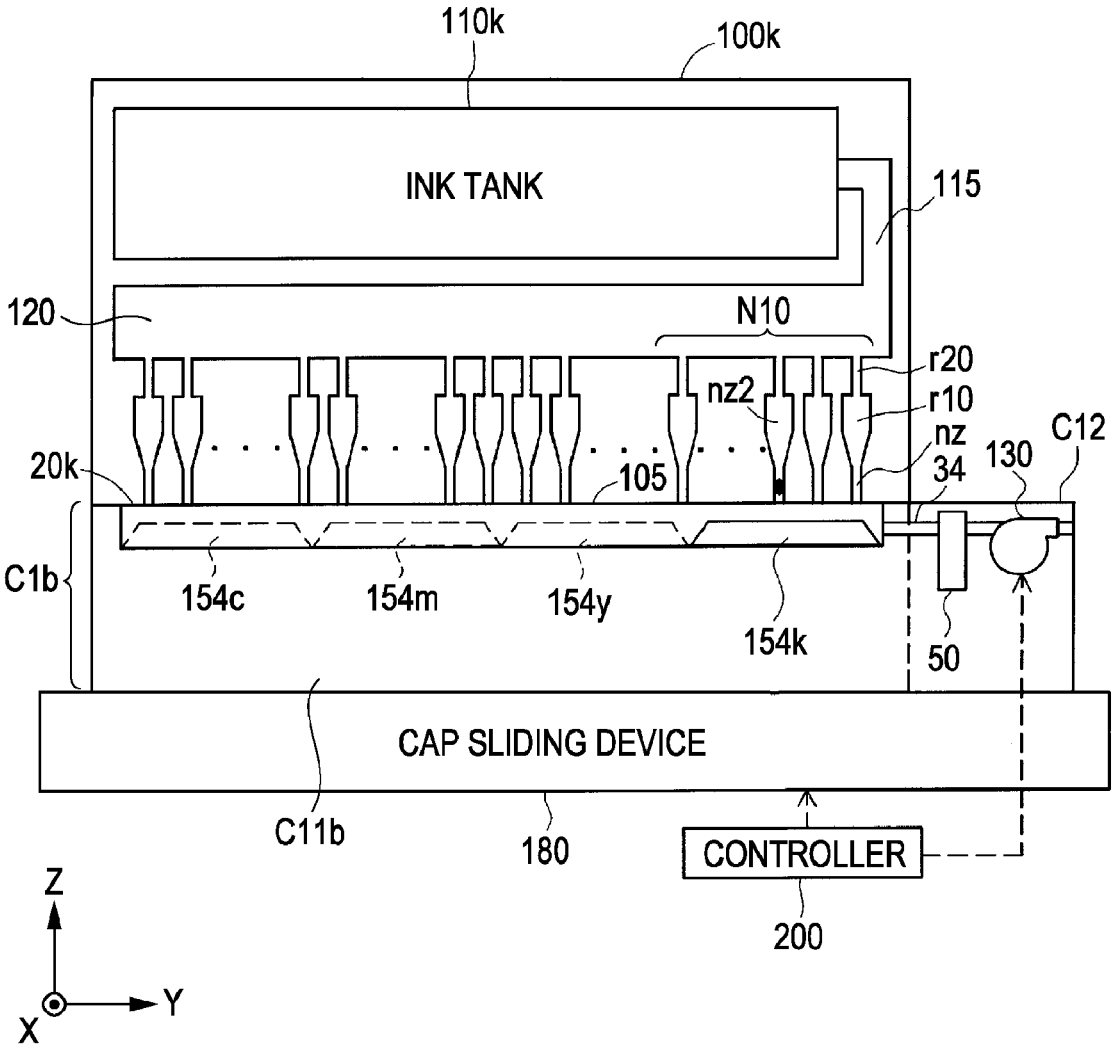
FIG. 11 illustrates a recording head portion and the cap in maintenance mode according to the third embodiment of the invention.

FIG. 11 illustrates the recording head portion 100*k* and the cap C1*b* in maintenance mode according to the third embodiment. In FIG. 11, a cross section of the recording head portion 100*k* and cap C1*b* taken along the line II-II in FIG. 1 are illustrated. The narrowing unit 154*k* is fixed in the ink flow channel 20*k*. The narrowing unit 154*k* is positioned so as to always support a nozzle group N10 at the right end. As previously described, the length of the narrowing unit 154*k* in the Y-axis direction is a quarter of the length of the ink flow channel 20*k*. Therefore, when the number of nozzles in the nozzle hole bank 10*k* is 6400, for example, the nozzle group N10 consists of 1600 nozzles nz.

Figure 12B:
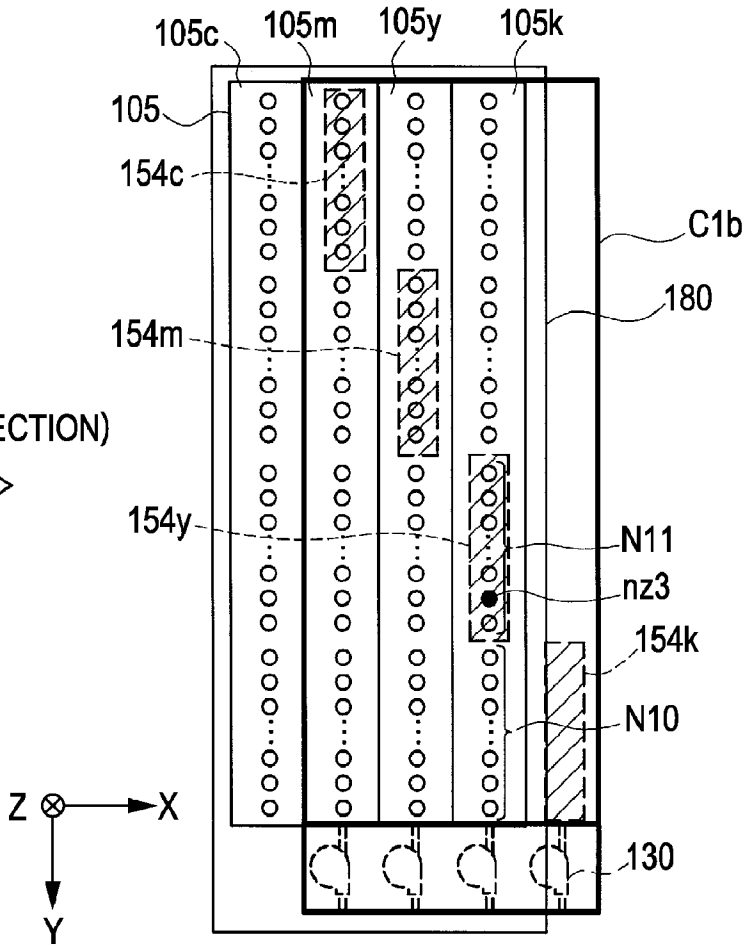
FIG. 12B illustrates a poorly discharging nozzle which has been detected in another nozzle group.
Figure 12A:
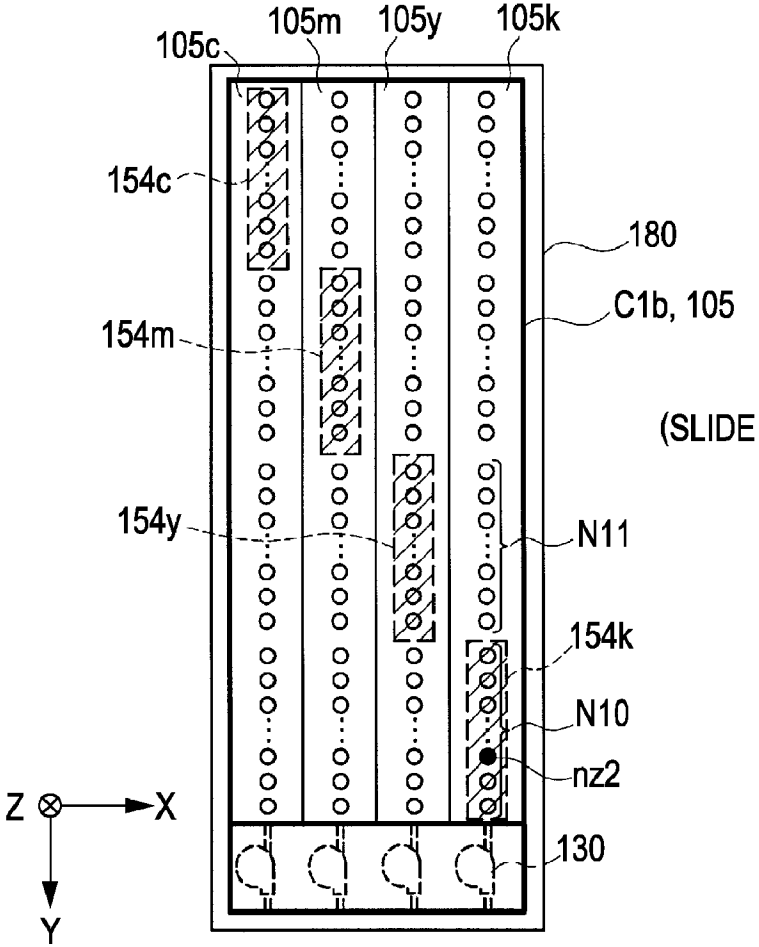
FIG. 12A illustrates the relationship between the recording head portion and the cap when a nozzle which has been discharging poorly has been detected.

FIG. 12A illustrates a relative positions between the recording head portion 100*k* and the cap C1*b* when a poorly discharging nozzle has been detected in the nozzle group N10 illustrated in FIG. 11. When a poorly discharging nozzle nz2 has been detected in the nozzle group N10, the cap C1*b* is not slid from its initial position. In this case, the narrowing unit 154*k* is positioned at a location that corresponds to the nozzle group N10, including the poorly discharging nozzle nz2. Accordingly, when the pump 130 performs sucking, large amount of negative pressure is produced in the nozzle group N10, and thickened ink is discharged from the poorly discharging nozzle nz2.

FIG. 12B illustrates a relative positional relationship between the recording head portion 100*k* and the cap C1*b* when a poorly discharging nozzle has been detected in a nozzle group N11 adjacent to the nozzle group N10. When a poorly discharging nozzle nz3 has been detected in the nozzle group N11 (consisting of 1600 nozzles) adjacent to the nozzle group N10, the cap sliding device 180 slides the cap C1*b* in the +X direction. At this time, the cap C1*b* is slid an amount which corresponds to the width of one of the bottom portions 105*c*, 105*m*, 105*y*, and 105*k*. Then, the narrowing unit 154*y* is positioned at a location that corresponds to the nozzle group N11, which includes the poorly discharging nozzle nz3. Accordingly, a large amount of negative pressure is produced in the nozzle group N11, and thickened ink is discharged from the poorly discharging nozzle nz3.

As in the structure described above, air bubbles and thickened ink are discharged only from the nozzles nz (nozzle group N10 or N11) which include the poorly discharging nozzle nz2 or nz3 at the center. Accordingly, the clogging of a nozzle can be eliminated without having to use a large-scale mechanism for creating negative pressure.

D. Modified Examples

Elements other than the elements described in the independent claims are additional elements and can be omitted as needed. The invention is not limited to the above embodiments. Various forms can be made without departing from the scope of the invention. Several examples of possible modifications are described below.

D1. First Modification Example

In the foregoing embodiments, the pump 130 sucks in air to create negative pressure in the ink flow channels 20*c*, 20*m*, 20*y*, and 20*k*. However, the invention is not limited to air sucking. For example, nitrogen gas may fill the ink flow channels 20*c*, 20*m*, 20*y*, and 20*k*. The subject to be sucked is not limited to gas, such as air or nitrogen gas. In one embodiment, a liquid, such as water or ink, can fill the ink flow channels 20*c*, 20*m*, 20*y*, and 20*k*. One such example is that, in a structure that uses ink, the ink flow channel 20*k* is filled with black ink. In this case, a passageway for supplying ink from the ink tank 110*k* to the ink flow channel 20*k* can be provided and the black ink can be supplied to the ink flow channel 20*k* through this passageway. That is, in general, a structure of sucking in any fluid supplied to each of the ink flow channels 20*c*, 20*m*, 20*y*, and 20*k* can be used in the fluid ejecting apparatus according to at least one aspect of the invention.

D2. Second Modification Example

In the foregoing embodiments, the pump 130 sucks in air to create negative pressure in the ink flow channels 20*c*, 20*m*, 20*y*, and 20*k*. As an alternative to this, a structure that sends air by the pump can be used instead of a pump which sucks air. More specifically, air may be sent into the ink flow channels 20*c*, 20*m*, 20*y*, and 20*k* and also into the ink supply passageway 120. At this time, negative pressure directed toward the corresponding ink flow channels 20*c*, 20*m*, 20*y*, and 20*k* from the ink supply passageway 120 can be created in each nozzle nz by use of a structure in which the flow rate of air in the ink flow channel 20*k* is higher than the flow rate of air in the ink supply passageway 120. In place of air, ink can be sent into both the ink supply passageway 120 and the ink flow channel 20*k*. In this case, for example, a bypass channel (not shown) communicating with the ink supply passageway 120 and the ink flow channel 20*k* can be provided and a pump (not shown) can be provided in the bypass channel. The pump enables black ink to be supplied to the ink supply passageway 120 and also to the ink flow channel 20*k* via the bypass channel. In this case, the flow rate of ink flowing in the ink flow channel 20*k* can be made to be higher than the flow rate of ink flowing in the ink supply passageway 120 by use of a structure in which the cross-sectional area of the ink flow channel 20*k* is smaller than the cross-sectional area of the ink supply passageway 120, so negative pressure can be created. That is, in general, a structure of passing any fluid supplied to each of the ink flow channels 20*c*, 20*m*, 20*y*, and 20*k* can be used in the fluid ejecting apparatus according to at least one aspect of the invention.

D3. Third Modification Example

In the foregoing embodiments, the presence or absence of discharged ink is optically detected in a direct manner to determine a poorly discharging nozzle. However, another method can be used to identify poorly discharging nozzles. Specifically, for example, a predetermined detection pattern can be actually printed on a printing sheet, and the detection pattern printed on the printing sheet can be scanned by, for example, a reading sensor to identify a poorly discharging nozzle. Maintenance can also be performed without detection of a poorly discharging nozzle. For example, in the nozzle hole banks 10*c*, 10*m*, 10*y*, and 10*k*, a sucking operation can be repeated while the narrowing unit is shifted sequentially from an end, so all the nozzle holes are subjected to the sucking operation. By using this structure, clogging in a poorly discharging nozzle can be eliminated. In addition, the amount of suction power required for each sucking operation is relatively small, so the clogging of a nozzle can be eliminated without having to use a large-scale mechanism for creating negative pressure. That is, in general, a detecting portion capable of detecting a poorly discharging nozzle using any method can be used in the fluid ejecting apparatus according to at least one aspect of the invention.

D4. Fourth Modification Example

In the foregoing embodiments, the shape of the pressure chamber r10 in each nozzle nz is changed by expanding and contracting the piezoelectric vibrator (not shown) in order to discharge ink. However, a heater can be used in place of the piezoelectric vibrator.

D5. Fifth Modification Example

In the foregoing embodiments, the printing sheet P is transported in the +X direction while the position of the recording head 100 is fixed. However, as an alternative to this, a structure in which the recording head 100 is moved (performs scanning) in the X-axis direction while the position of the printing sheet P is fixed can be used. Alternatively, a structure in which both the printing sheet P and the recording head 100 are moved can be used. That is, a structure in which at least one of the printing sheet P and the recording head 100 are moved in the scanning direction (X-axis direction) can be used. In the case in which the recording head 100 is moved (performs scanning), a mechanism for moving the recording head 100 (not shown) comprises a scanning portion.

D6. Sixth Modification Example

In the foregoing embodiments, the recording head 100 is a line recording head. However, in place of a line recording head, a serial recording head can be used. A recording head including a plurality of serial recording heads arranged may also be used. Examples of such a recording head including a plurality of serial recording heads include a recording head in which a plurality of serial recording heads are aligned in a line in a direction that is substantially perpendicular to the transport direction and a recording head in which a plurality of serial recording heads are aligned in a staggered arrangement.

D7. Seventh Modification Example

In the foregoing embodiments, an ink jet printer is used as an example of a fluid discharging apparatus capable of performing aspects of the invention. However, the invention is not limited to the ink jet printer and may also be applied to any fluid ejecting apparatus for ejecting fluid other than ink. For example, fluid ejecting apparatus which eject liquid, liquid in which particles of functional material are distributed, and solids capable of being ejected as fluid (e.g., powder) may be used. For example, the invention is also applicable to a liquid ejecting apparatus for ejecting liquid including a material that may be distributed or dissolved, such as a coloring material or a material for forming an electrode for use in the manufacture of a liquid crystal display, an electroluminescent display, or a surface emitting display. The invention is also applicable in liquid ejecting apparatuses for ejecting biomolecules for use in the manufacture of biochips, liquid ejecting apparatuses used as precision pipettes for ejecting a specimen of liquid, liquid ejecting apparatuses for ejecting a pinpoint amount of a lubricant to a precision mechanism, such as a watch or camera, and liquid ejecting apparatuses for ejecting light-transmitting resin liquids onto a substrate to form, such as ultra-violet curing resins for example, a minute hemispherical lens (optical lens) for use in an optical communications element. Moreover, the present invention may be used in liquid ejecting apparatuses for ejecting etching liquid, such as acid or alkaline material, to etch a substrate, and ejecting apparatuses for ejecting a solid, such as powder (e.g., toner).

What is claimed is:

1. A fluid ejecting apparatus capable of ejecting a fluid, the fluid ejecting apparatus comprising:

a recording head comprising a plurality of nozzles arranged in a nozzle arrangement direction and a storage portion capable storing the fluid, the recording head being capable of ejecting the fluid through the plurality of nozzles onto a paper, the nozzle arrangement direction corresponding to a paper width direction; and a recording head capping device that is capable of coming into contact with a discharge surface of the fluid in the recording head where the fluid is discharged from the plurality of nozzles and is further capable of receiving the fluid discharged through the plurality of nozzles, the recording head capping device comprising:

a cap-side channel being arranged so as to face the plurality of nozzles when the recording head capping device is in contact with the discharge surface, the cap-side channel including a small cross-sectional section where the cross-sectional area of the cap-side channel is relatively small, and a large cross-sectional section where the cross-sectional area of the cap-side channel is relatively high;

a passing portion capable of creating a negative pressure in at least part of the plurality of nozzles by passing a material through the cap-side channel;

a narrowing portion arranged in the cap-side channel which is capable of narrowing a portion of the cap-side channel as it reciprocates in the nozzle arrangement direction with respect to the recording head capping device; and a positioning portion capable of adjusting the position of the narrowing portion of the cap-side channel in the nozzle arrangement direction, such that the narrowing portion moves independently of the recording head capping device within the cap-side channel in the paper width direction, wherein the positioning portion narrows a predetermined portion of the cap-side channel in order to create small cross-sectional area section of the cap-side channel.

2. The fluid ejecting apparatus according to claim 1, further comprising:

a poor discharge detecting portion capable of detecting when a nozzle from among the plurality of nozzles is discharging poorly, wherein the positioning portion adjusts the position of the narrowing portion so that the area of the cap-side channel facing the poorly discharging nozzle is the high flow rate section of the cap-side channel.

3. The fluid ejecting apparatus according to claim 1, wherein the material passed through the passing portion is air.

4. The fluid ejecting apparatus according to claim 1, wherein the material passed through the passing portion is a second fluid.

5. The fluid ejecting apparatus according to claim 1, wherein the narrowing unit and positioning unit comprise electromagnets.

* * * * *